US009283691B2

(12) United States Patent
Tschanen

(10) Patent No.: US 9,283,691 B2
(45) Date of Patent: Mar. 15, 2016

(54) METHOD OF MAKING A LOG INSULATOR

(71) Applicant: Chris Tschanen, Hermitage, TN (US)

(72) Inventor: Chris Tschanen, Hermitage, TN (US)

( * ) Notice: Subject to any disclaimer, the term of this patent is extended or adjusted under 35 U.S.C. 154(b) by 281 days.

(21) Appl. No.: 13/783,992

(22) Filed: Mar. 4, 2013

(65) Prior Publication Data

US 2014/0246402 A1 Sep. 4, 2014

(51) Int. Cl.

| | |
|---|---|
| ***B27C 3/02*** | (2006.01) |
| ***B27H 5/00*** | (2006.01) |
| ***B65D 81/38*** | (2006.01) |
| ***A47G 23/02*** | (2006.01) |
| *B65D 25/34* | (2006.01) |
| *B65D 25/14* | (2006.01) |

(52) U.S. Cl.

CPC ..... *B27C 3/02* (2013.01); *A47G 23/0266* (2013.01); *B27H 5/00* (2013.01); *B65D 81/3876* (2013.01); *B65D 81/3886* (2013.01); *B65D 25/14* (2013.01); *B65D 25/34* (2013.01)

(58) Field of Classification Search

CPC ..... B27C 3/02; B27C 3/08; B27C 9/00; B27C 9/02; B27H 3/00; B27H 5/00; B27M 1/00; B27M 1/08; B27M 3/34

USPC ..... 144/92, 93.1, 104, 365

See application file for complete search history.

(56) References Cited

U.S. PATENT DOCUMENTS

| | | | | |
|---|---|---|---|---|
| 3,028,891 | A * | 4/1962 | Dillingham | 144/208.6 |
| 6,102,089 | A * | 8/2000 | McCormick | 144/1.1 |
| 2007/0034625 | A1* | 2/2007 | Pacheco | 220/4.21 |

OTHER PUBLICATIONS

How to Make a Log Planter, ehow.com/how_7668133_make-log-planter.html, Captured Jun. 6, 2011.*

Is Your Wood Dry Enough, woodworkweb.com/woodwork-tompics/wood/74-is-your-wood-dry-enough.html, Nov. 26, 2007.*

Victor Repp, Willard McCarhty, Machine Tool Technology, 1984, Glencoe/McGraw-Hill, pp. 481-482.*

Thomas Baker, All About Polyurethane, www.thisoldhouse.com/toh/photos/0,,20414984,00.html.*

* cited by examiner

*Primary Examiner* — Shelley Self

*Assistant Examiner* — Matthew G Katcoff

(74) *Attorney, Agent, or Firm* — Braxton, Hilton & Perrone PLLC

(57) ABSTRACT

A koozie and method of making a same. A suitable log is first selected. The size of the log can vary depending upon the size of the desired koozie. The log is cut into at least one segment. The segments are secured to a table. Next, the segments are hollowed leaving a bottom plane and a stem extending from the bottom plane. Thereafter the stem is removed. This provides a koozie made from a log.

15 Claims, 6 Drawing Sheets

METHOD OF MAKING A LOG INSULATOR

BACKGROUND OF THE INVENTION

1. Technical Field

The present invention relates to a log insulator and a method for making the same.

2. Description of Related Art

When drinking out of a bottle or can, it is common to insulate the bottle or can to keep the drink either hot or cold. An insulating container, referred to herein as a koozie, often surrounds at least a portion of the bottle, can, or other item holding a beverage. Koozies are often foam in structure, and people often treat koozies as throw-away objects. Consequently it is desirable to have an attractive and distinctive koozie which can be reused.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicants' invention will now be described with reference to the drawings. Unless otherwise noted, like elements will be identified by identical numbers throughout all figures. The invention illustratively disclosed herein suitably may be practiced in the absence of any element which is not specifically disclosed herein.

Figure 1A:
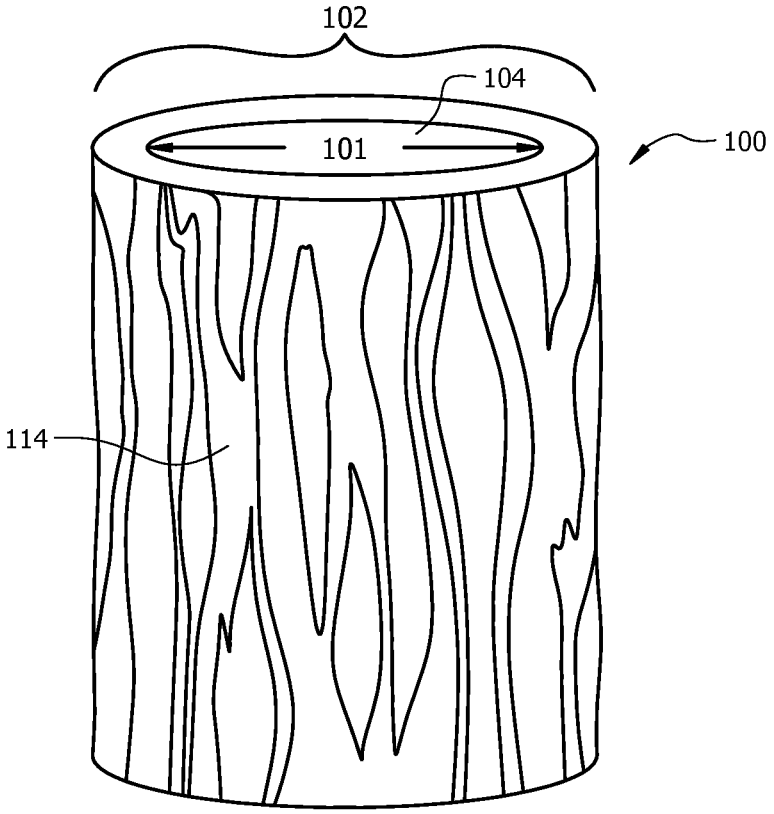
FIG. 1A is a perspective view of a koozie made from a log in one embodiment.

FIG. 1A is a perspective view of a koozie made from a log in one embodiment. A log, and the wood therefrom, is a natural insulator and functions well as a koozie. The wood offers a unique design which stands out compared to prior art foam koozies. Further, a wooden koozie is sturdier than a foam koozie which is often susceptible to tipping as the beverage becomes empty. Additionally, wood offers a unique surface that can be carved or engraved. Unique messages, such as names, can be engraved or carved into the wooden koozie. Furthermore, many types of wood float which is a benefit if the koozie is used in a pool, river, lake, or ocean.

As depicted in FIG. 1A, the bark has been removed but the cambium layer remains. The cambium layer is a layer which resides between the bark and the wood. The cambium layer has a distinctive design, but is smoother than bark. Bark can be difficult to hold and rough on the hands. Thus, removing the bark so that the cambium layer is exposed provides for a more comfortable koozie compared to a koozie with the bark remaining In one embodiment wherein the cambium layer is exposed, staining is not required. Because cambium shows the wood features and colors, including the wood grain, staining is not generally required when the cambium layer is shown. This is contrasted, for example, to a pine log wherein the bark and cambium has been removed. In such a scenario, staining may be required to enhance the color of the grain. By removing the necessity of staining, the time and expense of staining in manufacturing is reduced. This is a large benefit during manufacturing.

The koozie 100 has an outer diameter 102 and an inner diameter 101. The inner diameter 101 and outer diameter 102 can be adjusted depending on the beverage container. In one embodiment the inner diameter 101 ranges from about 2 and ⅝ inches to about 3 inches.

The koozie 100 also comprises a cavity 104. A beverage container, such as a can, bottle, or any type of container, is inserted into the cavity 104.

The height of the koozie 100 can be varied depending upon the beverage container. In one embodiment the koozie 100 has a height of between about 4 inches and 6 inches, and in one embodiment the koozie 100 has a height of about 4.5 inches.

Figure 1B:
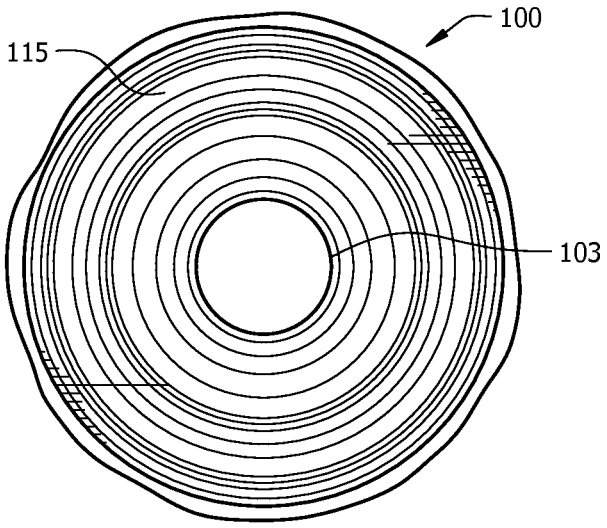
FIG. 1B is a bottom view of the koozie depicted in FIG. 1A.

FIG. 1B is a bottom view of the koozie depicted in FIG. 1A. In the embodiment depicted, the koozie 100 comprises a condensate drain 103. The condensate drain 103 is a hole in which condensate can exit the koozie. Without a condensate drain, condensate would collect in the koozie, and when the koozie was tilted, the condensate would spill out of the top opening of the koozie and likely get on the user. A condensate drain 103 prevents this scenario by providing a place for the condensate to exit toward the bottom of the koozie so that the condensate does not collect within the koozie.

As depicted, the condensate drain 103 is located in the bottom plane 115 of the koozie 100. This allows the condensate to exit at the bottom plane 115. The condensate drain 103 can comprise a variety of sizes and shapes. In one embodiment the condensate drain 103 has a diameter ranging from about 0.5 inches to about 1 inch. In one embodiment the condensate drain 103 comprises a diameter of about ¾ of an inch. Such a size, for a koozie sized to hold a beer can, provides sufficient space for the condensate to drain.

While depicted as being a single hole, the condensate drain 103 can comprise one or more holes. Further, while being depicted as being located in the bottom plane 115, in other embodiments one or more condensate drains 103 can be located in the koozie wall 114.

Figure 2:
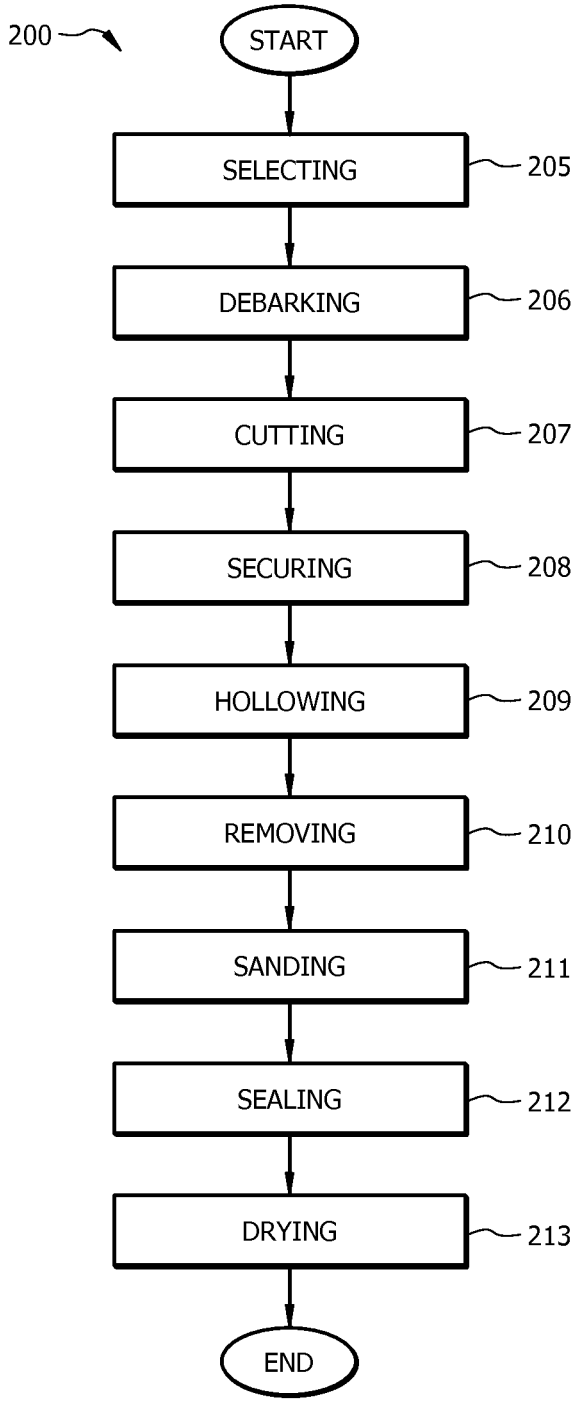
FIG. 2 is a flow chart of a method of making a koozie in one embodiment.

FIG. 2 is a flow chart of a method of making a koozie in one embodiment. FIG. 2 depicts one example method of making a koozie and is for illustrative purposes only. The method begins with the selecting step 205. In the selecting step 205, suitable logs are selected. In one embodiment, the logs are properly dried and comprise a moisture content of 20% or less. Such a moisture content prevents logs from splitting during subsequent drilling.

Almost any type of log can be utilized including pine, cedar, aspen, birch, oak, mesquite, hedge, rosewood, koa, spruce, etc. The size of the selected logs is dependent upon the desired size of the final koozie 100. In one embodiment logs with lengths of 10 feet or greater and diameters ranging from 3 inches to 5 inches are selected. Often the logs will have a diameter of 5 inches at the top and a diameter of 3 inches at the bottom.

Figure 3:
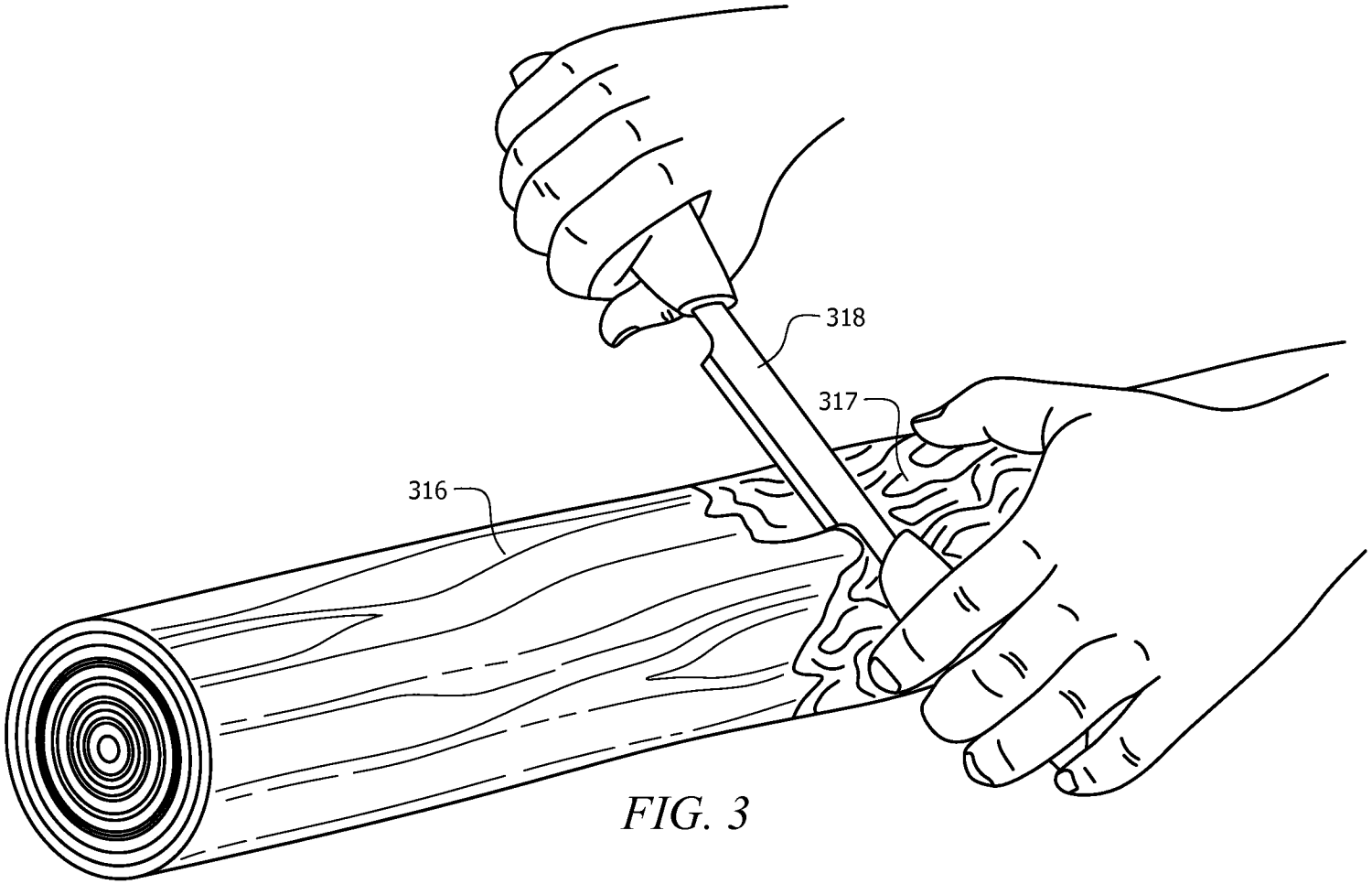
FIG. 3 is a perspective view of a log being debarked in one embodiment.

Next, the logs are debarked in an optional debarking step 206. FIG. 3 is a perspective view of a log being debarked in one embodiment. As can be seen, the cambium layer 316 is smoother and less jagged than the bark layer 317. The bark can be removed with any device known in the art. In one embodiment a drawing knife 318 is used to remove the bark.

After debarking 206, the logs are cut into segments of suitable lengths in the cutting step 207. As noted, the length of the segment is dependent upon the desired final koozie 100. In one embodiment the length of the segment ranges from about 4 inches to 6 inches, and in one embodiment the length is about 4.5 inches. The cutting step 207 can comprise any device known to cut logs including a saw, skill saw, chain saw, miter saw, etc.

It should be noted that while the debarking step 206 is depicted before the cutting step 207, this is not limiting. The debarking step 206 can occur, if at all, at any time during the manufacturing including after the cutting step 207. In one embodiment it is more efficient to debark the logs before they are cut into segments. In some embodiments, however, the bark is not removed.

Figure 4:
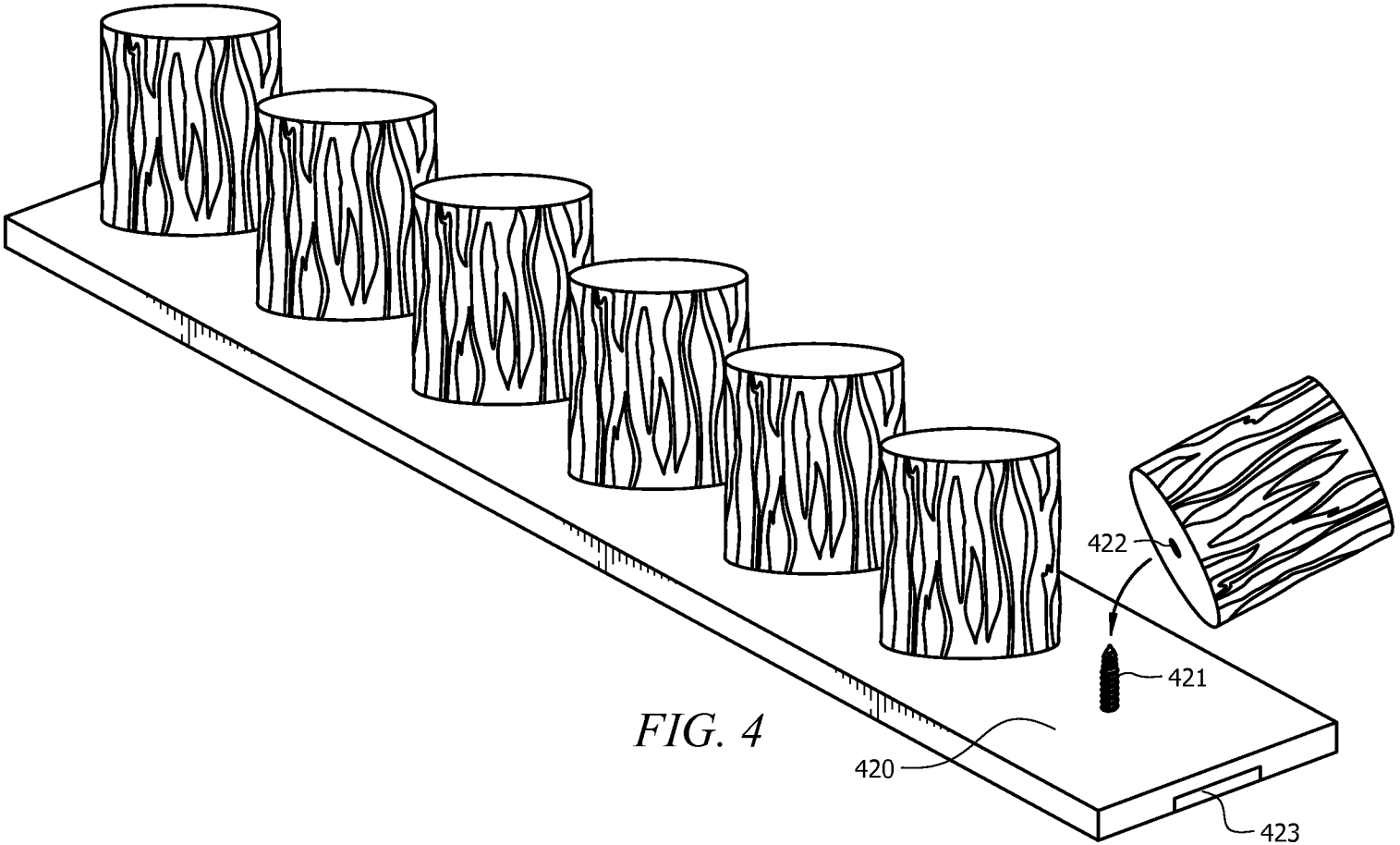
FIG. 4 is a perspective view of a plurality of logs arranged to be hollowed in one embodiment.

After the cutting step 207, at least one segment is secured to a table during the securing step 208. FIG. 4 is a perspective view of a plurality of logs arranged to be hollowed in one embodiment. The securing step 208 can comprise any method known for securing a log segment to a table including screws, bolts, nails, glue, clamps, etc. In one embodiment, a small hole 422 is drilled in the approximate center of the segment. The small hole 422 then couples to a securing device 421 which is coupled to a table 420. The securing device 421 can comprise any device known to secure including a screw, bolt, nail, etc. Thus, by coupling the securing device 421 with the small hole 422, the segment becomes secured to the table 420. As depicted, the securing device 421 comprises a screw which is screwed tightly into the segment. This allows the segment to be controlled by manipulating the table 420 as described below.

The table 420 can comprise any material. In one embodiment the table 420 comprises wood with a metallic backing 423. The backing 423 strengthens the table 420 and offers additional support. As depicted, the securing device 421 is secured to the backing 423.

The table can comprise any number of segments. In one embodiment the table 420 comprises between 1 and 10 segments.

After the securing step 208 is the hollowing step 209. The hollowing step 209 is the step wherein a cavity is cut into the segment. The hollowing step 209 can comprise any method for creating a cavity in a segment of wood including using a computer numerical control ("CNC") machine, a self-feeding auger bit or a wood lathe. A CNC machine uses computer instructions to determine where and how to drill a hole. A plot of a desired product can be inserted into the CNC machine, and the machine can implement the plot on an object. Thus, for example, a user can instruct a CNC machine to create a cavity with an inner diameter of three inches and a depth of 4 inches. The CNC machine then recreates the plot on a log. The CNC machine has many advantages compared to a self-feeding auger bit or a wood lathe. First a CNC machine is very fast. The hollowing step 209 for one koozie, in one embodiment using a CNC machine, takes about 40 seconds. Such speeds cannot be achieved on a lathe or self-feeding auger bit. Second, a CNC machine offers superior consistency and accuracy. Because the CNC is computerized, the CNC machine can reliably produce uniform koozies. In one embodiment, the hollowing step 209 comprises a CNC machine.

Figure 5:
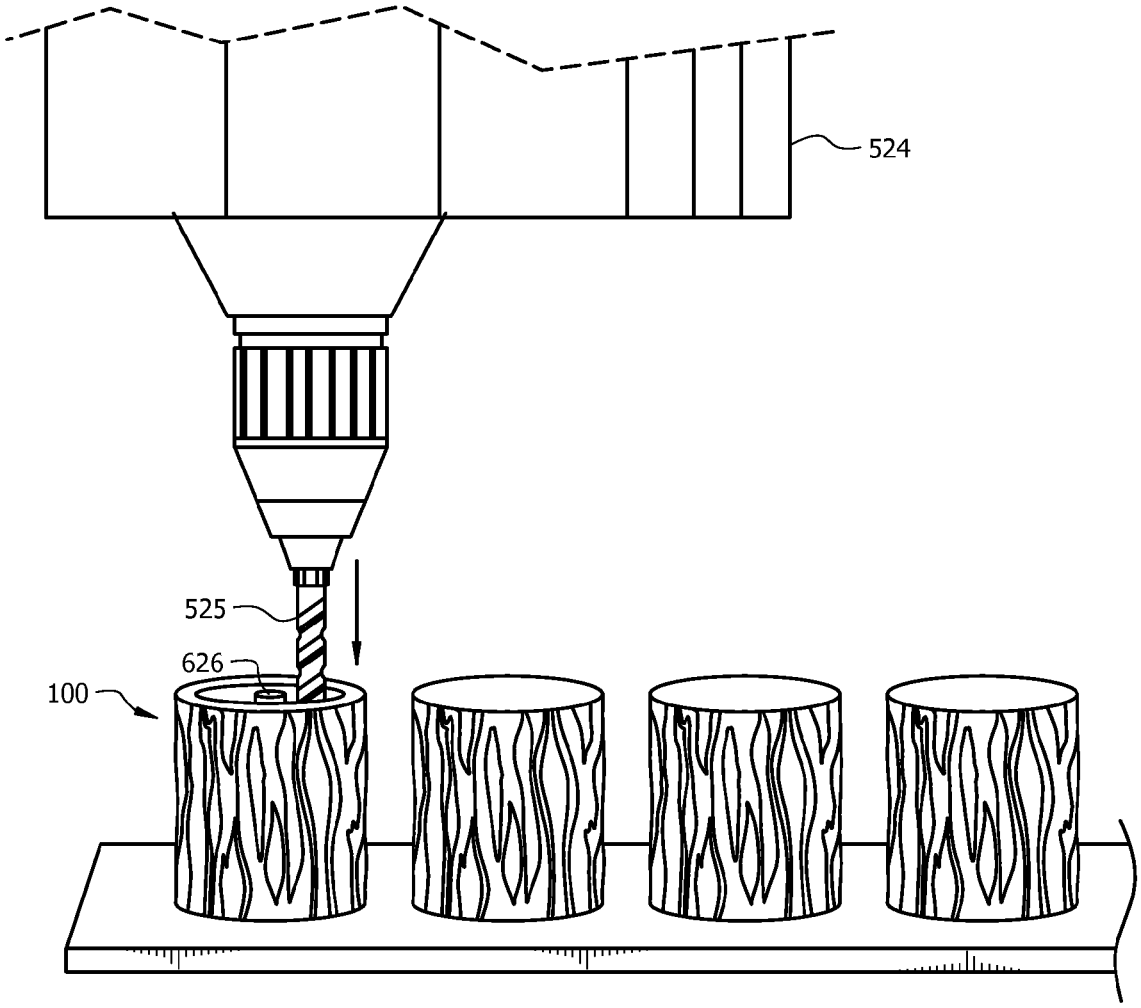
FIG. 5 is a perspective view of a plurality of logs being hollowed in one embodiment.
Figure 6:
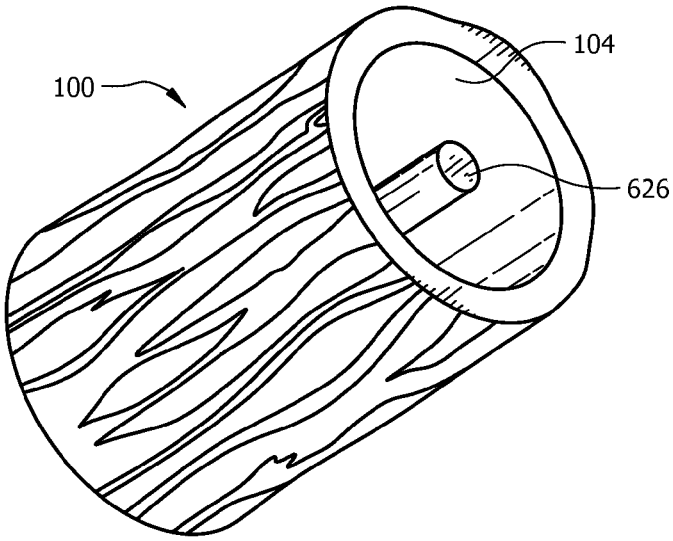
FIG. 6 is a top view of a hollowed log in embodiment.

FIG. 5 is a perspective view of a plurality of logs being hollowed in one embodiment with a CNC machine. FIG. 6 is a top view of a hollowed log in one embodiment. As can be seen from FIGS. 5 and 6, the segment comprises a stem 626. A stem 626 is a portion of the log in the approximate center of the cavity 104, still attached to the bottom plane 115 and which remains after hollowing. In one embodiment, the stem 626 is located in the same location as the securing device 421. Thus, if the stem 626 were removed by the drill bit 525 of the CNC machine 524 (as shown in FIG. 5), the drill bit 525 would have to contact the securing device 421, which could damage the drill bit 525. Because drill bits 525 of the CNC machine 524 are often expensive, contact between the drill bit 525 and the securing device 421 is to be avoided. Thus, in one embodiment, a cavity 104 is created which extends downward to the bottom plane 115 but which comprises a stem 626. If a securing device 421 can be used which does not extend into the created cavity such that contact between the securing device 421 and the drill bit 525 can be avoided, then the hollowing can occur without leaving a stem 626.

In one embodiment, the cavity 104 is created by the drill bit 525 on the CNC machine 524 by creating a series of adjacent holes. Thus, the cavity shape is created by drilling several smaller holes which together make the cavity.

The drill bit 525 can comprise a wide range of diameters depending upon the size of the final koozie. In one embodiment the drill bit 525 comprises a 6 inch spiral bit with a diameter of about ¾ of an inch. The drill bit 525 is lowered to the segment. The beginning location of the drilling is controlled by the CNC machine 524. The drill bit 525 drills a hole into the segment which extends to the bottom plane. In one embodiment, the depth, controlled by the CNC machine 524, is such that the bottom plane is not drilled. Put differently, the bottom plane remains solid and does not have any drill holes there through.

After creating one hole, the CNC machine 524 is manipulated to drill an additional hole. In one embodiment the additional hole is located adjacent to the previous hole but offset in the clockwise direction. In one embodiment the drill bit 525 moves only vertically and does not move horizontally. Instead, the table 420 is moved so as to position the drill bit 525 to drill the additional adjacent hole. In other embodiments, however, the table 420 is stationary, and the CNC machine 524 moves the drill bit 525 to drill the additional adjacent hole. Whether the table 420 moves or the drill bit 525 moves, the movements are controlled by the CNC machine 524.

Next, an additional hole is drilled and the CNC machine 524 is again manipulated. In this way, several holes are drilled into the segment so that eventually the cavity 104 depicted in FIG. 6 is produced. In one embodiment, the process of preparing the cavity 104 takes about 40 seconds per segment. The spacing between segments, number of segments, desired depth, desired inner and outer diameter, diameter of the stem 626, and other factors can be inputted into the CNC machine.

After the hollowing step 209, the stem 626 is removed in the removing step 210. In one embodiment the removing step 210 comprises detaching the segment from the table 420. Thereafter, a hole is drilled in the bottom plane 115 which corresponds to the location of the stem 626. In one embodiment, the diameter of the drilled hole is larger than the diameter of the stem 626. When the portion of the bottom plane 115 which is attached to the stem 626 is removed, the stem 626 falls away from the segment leaving a hole in the bottom plane 115. In one embodiment the hole drilled in the bottom plane 115 is the condensate drain 103, depicted in FIG. 1B. Thus, in one embodiment a single drill hole simultaneously removes the stem 626 and creates at least one condensate drain 103. Consolidation of steps increases throughput and reduces time of production.

After the stem is removed, a koozie is formed. The cavity 104 no longer comprises a stem 626 so a beverage container can be inserted. However, in one embodiment, an optional sanding step 211 is conducted whereby edges are rounded. During the cutting step 207 the cut edges are often sharp. Sanding 211 provides the user with a smoother and splinter-free koozie.

After the sanding step 211 is an optional sealing step 212. The sealing step 212 can utilize virtually any sealant known in the art. Sealant is used to protect wood, maintain its appearance, and to act as a moisture barrier. The sealant can be applied to both the internal and external surfaces of the koozie, or the sealant can be applied only to the external surfaces. Further, different sealants can be applied to the internal and external surfaces. In one embodiment a polyurethane coating is applied to only the external surface, and in other embodiments, the polyurethane coating is also applied to the internal surfaces.

The sealant can be sprayed or brushed onto the koozie. In one embodiment two or more coats are applied to the koozie. The koozies are then dried in a drying step 213. However, depending upon the sealant utilized, the drying time can vary. In one embodiment by the time downstream koozies have been sealed, the upstream sealant coat has already dried.

Figure 7:
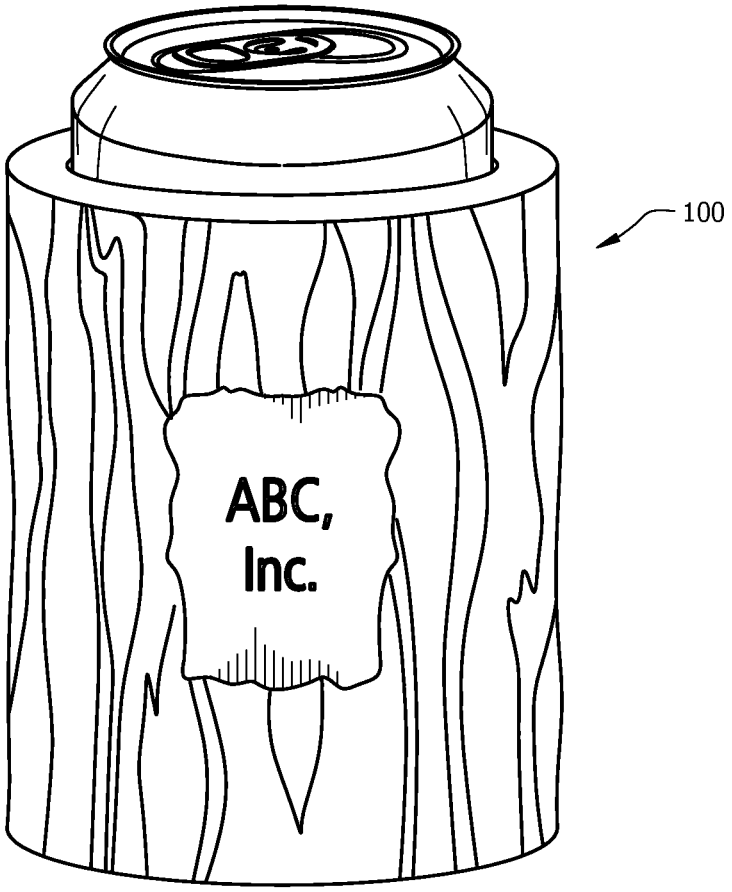
FIG. 7 is a perspective view of a koozie holding a can in one embodiment.

FIG. 7 is a perspective view of a koozie holding a can in one embodiment. As noted, the container, such as a can or bottle, can be inserted into the koozie 100. The koozie 100 is an insulator which keeps hot beverages hot and cold beverages cold. Further, the koozie 100 increases comfort to the user who may not want to hold a cold can on a cold night, for example. As depicted, the koozie 100 is engraved with a name. The koozie 100 can be engraved with a message, including but not limited to a name, business name, logo, phrase, saying, etc. The message can be engraved directly into the wood, or the message can be affixed to the wood via tape, glue, screws, or any other device known for affixing. As an example, in one embodiment the message is engaged in a metallic plaque which is then affixed to the koozie 100.

While the invention has been particularly shown and described with reference to a preferred embodiment, it will be understood by those skilled in the art that various changes in form and detail may be made therein without departing from the spirit and scope of the invention.

Additional Description

The following clauses are offered as further description of the disclosed invention.

1. A method of making a koozie, said method comprising:
   a) selecting a log;
   b) cutting said log into at least one segment;
   c) securing at least one segment to a table;
   d) hollowing said at least one segment such as to leave a stem and a bottom plane, wherein said stem is connected to said bottom plane; and
   e) removing said stem.
2. The method according to clause 1 further comprising debarking said log.
3. The method according to any preceding clause wherein said debarking comprises debarking so as to expose a cambium layer.
4. The method according to any preceding clause wherein said log comprises a moisture content of less than 20%.
5. The method according to any preceding clause wherein said securing step comprises securing a segment to said table with a securing device.
6. The method according to clause 5 wherein said securing device comprises a screw.
7. The method according to clause 5 wherein said stem corresponds to the location of said securing device.
8. The method according to any preceding clause wherein said hollowing step comprises hollowing with a computer numerical control machine.
9. The method according to clause 8 wherein said computer numerical control machine comprises a drill bit, and wherein said drill bit comprises a diameter of about ¾ of an inch.
10. The method according to any preceding clause wherein said removing step comprises drilling a hole in said bottom plane, wherein said hole comprises a larger diameter than said stem.
11. The method according to any preceding clause further comprising sanding said segment.
12. The method according to any preceding clause further comprising sealing said segment.
13. The method according to clause 12 wherein said sealing comprising polyurethane.
14. The method according to any preceding clause wherein said cutting comprising cutting into a length of about 4.5 inches.
15. The method according to any preceding clause wherein said hollowing comprises hollowing such that said bottom plane remains solid.
16. A koozie made by the method according to clause 1.
17. A koozie comprising:
    a cylindrical koozie wall extending from a bottom plane, wherein said koozie wall comprises an inner diameter and an outer diameter;
    at least one condensate drain;
    wherein said koozie wall comprises debarked wood comprising an exposed cambium layer.
18. The koozie according to clause 17 wherein said condensate drain is located in said bottom plane.
19. The koozie according to clause 18 wherein said condensate drain comprises a diameter of about ¾ of an inch.
20. The koozie according to clauses 17-19 wherein said inner diameter is about 2 and ⅝ inches.
21. The koozie according to clauses 17-20 wherein said koozie comprises a height of about 4.5 inches.
22. The koozie according to clauses 17-21 wherein said koozie comprises rounded edges.

I claim:

1. A method of making a koozie, said method comprising:
a) selecting a log;
b) cutting said log into at least one segment;
c) securing at least one segment to a table;
d) hollowing said at least one segment to form a cavity; wherein said cavity extends downward to a bottom plane of said segment; and wherein said cavity comprises a stem which is attached to said bottom plane and which extends upwards from the bottom plane into said cavity; and
e) removing said stem by detaching said segment from a table and drilling a hole in the bottom plane corresponding to the location of the stem.

2. The method of claim 1 further comprising debarking said log.

3. The method of claim 2 wherein said debarking comprises debarking so as to expose a cambium layer.

4. The method of claim 1 wherein said log comprises a moisture content of less than 20%.

5. The method of claim 1 wherein said securing step comprises securing a segment to said table with a securing device; and wherein said stem is located in approximately the center of said cavity.

6. The method of claim 5 wherein said securing device comprises a screw.

7. The method of claim 5 wherein said stem corresponds to the location of said securing device.

8. The method of claim 1 wherein said hollowing step comprises hollowing with a computer numerical control machine.

9. The method of claim 8 wherein said computer numerical control machine comprises a drill bit, and wherein said drill bit comprises a diameter of about ¾ of an inch.

10. The method of claim 1 wherein said removing step comprises drilling a hole in said bottom plane, wherein said hole comprises a larger diameter than said stem.

11. The method of claim 1 further comprising sanding said segment.

12. The method of claim 1 further comprising sealing said segment.

13. The method of claim 12 wherein said sealing comprising polyurethane.

14. The method of claim 1 wherein said cutting comprising cutting into a length of about 4.5 inches.

15. The method of claim 1 wherein said hollowing comprises hollowing such that said bottom plane remains solid.

* * * * *